US007714242B2

(12) United States Patent
Ishigaki et al.

(10) Patent No.: US 7,714,242 B2
(45) Date of Patent: May 11, 2010

(54) SWITCH DEVICE

(75) Inventors: Seiji Ishigaki, Aichi (JP); Masahiko Miyata, Aichi (JP); Tomio Yamada, Aichi (JP); Terukazu Hiroe, Aichi (JP)

(73) Assignee: Kabushiki Kaisha Tokai Rika Denki Seisakusho (JP)

( * ) Notice: Subject to any disclaimer, the term of this patent is extended or adjusted under 35 U.S.C. 154(b) by 539 days.

(21) Appl. No.: 11/758,948

(22) Filed: Jun. 6, 2007

(65) Prior Publication Data

US 2007/0284233 A1 Dec. 13, 2007

(30) Foreign Application Priority Data

Jun. 9, 2006 (JP) ..... 2006-160841
Oct. 31, 2006 (JP) ..... 2006-295566

(51) Int. Cl.
*H01H 9/20* (2006.01)

(52) U.S. Cl. ..... 200/336; 200/564; 200/43.11; 335/205

(58) Field of Classification Search ..... 200/43.01, 200/43.11, 43.16, 564–567, 318, 323, 327, 200/336; 341/20, 211, 35, 32, 27; 345/156, 345/184; 335/205–207, 179
See application file for complete search history.

(56) References Cited

U.S. PATENT DOCUMENTS 3,499,133 A * 3/1970 Sykora et al. ..... 200/11 A
5,774,075 A * 6/1998 Palalau et al. ..... 341/35
5,867,082 A * 2/1999 Van Zeeland ..... 335/205
6,380,733 B1 * 4/2002 Apel et al. ..... 324/207.2
6,404,354 B1 * 6/2002 Decker et al. ..... 341/35
6,613,997 B2 * 9/2003 Oster et al. ..... 200/564
6,756,967 B2 * 6/2004 Onodera et al. ..... 345/161
6,828,957 B2 * 12/2004 Onodera ..... 345/156
6,987,508 B2 * 1/2006 Numata et al. ..... 345/184
7,038,148 B2 * 5/2006 Shirakawa ..... 200/43.11
7,439,835 B2 * 10/2008 Dietrich et al. ..... 335/207
7,468,646 B2 * 12/2008 Osterberg ..... 335/179

FOREIGN PATENT DOCUMENTS

EP 1 217 496 A2 6/2002
EP 1 471 551 A2 10/2004
EP 1 480 238 A2 11/2004
JP 2003-086059 3/2003
JP 2004-022301 1/2004
JP 2004-220957 8/2004

* cited by examiner

*Primary Examiner*—Michael A Friedhofer
(74) *Attorney, Agent, or Firm*—Crompton, Seager & Tufte LLC

(57) ABSTRACT

A switch device including a switch operation shaft movable between a plurality of operation positions for setting a control amount for an apparatus. A follower is driven to follow the movement of the switch operation shaft. An attraction member generates magnetic force to attract the follower so that the follower becomes immovable and to hold the switch operation shaft at a single operation position.

12 Claims, 3 Drawing Sheets

SWITCH DEVICE

CROSS-REFERENCE TO RELATED APPLICATIONS

This application is based upon and claims the benefit of priority from prior Japanese Patent Application No. 2006-160841, filed on Jun. 9, 2006, and Japanese Patent Application No. 2006-295566, filed on Oct. 31, 2006, the entire contents of which are incorporated herein by reference.

BACKGROUND OF THE INVENTION

The present invention relates to a switch device operated when activating various devices.

Generally, a rotary switch is rotated to activate, deactivate, or vary a control amount of an apparatus. Japanese Laid-Open Patent Publication No. 2004-22301, Japanese Laid-Open Patent Publication No. 2004-220957, and Japanese Laid-Open Patent Publication No. 2003-086059 disclose conventional rotary switches. A conventional rotary switch includes a click mechanism to ensure that an operator performs a switching operation and to provide the operator with a comfortable operation feel. For example, a mechanical click mechanism of a rotary switch includes an immovable member and a rotatable member. One of the immovable member and the rotatable member includes recesses, and the other one of the immovable member and the rotatable member includes projections. Engagement of at least one of the recesses and at least one of the projections produces operation resistance.

SUMMARY OF THE INVENTION

A rotary switch varies the control amount of an apparatus in accordance with the rotational angle (rotation amount) of a knob. Thus, a rotary switch is effective for accurately adjusting the control amount of an apparatus. In the prior art, rotary switches have an operable rotational angle range of 120 degrees, 180 degrees, 270 degrees, 360 degrees, or 360 degrees or greater. The operable rotational angle range is been determined by adjusting the position at which a stopper is arranged or formed. The stopper engages an operation shaft supporting the knob to restrict the rotation of the operation shaft. Accordingly, plural types of rotary switches that differ from each other only in the operable rotational angle range are manufactured as different products.

Various types of rotary switch that differ only in the operable rotational angle range are required in a vehicle that requires many rotary switches to operate many devices. This increases the number of components and makes the management of components complicated. Therefore, there is a demand for a rotary switch having an improved versatility.

It is an object of the present invention to provide a versatile switch device that can be held at any operation position while enabling the setting of any operable rotation angle range.

One aspect of the present invention is a switch device for setting a control amount for an apparatus. The switch device includes a switch operation shaft movable between a plurality of operation positions for setting the control amount for the apparatus. A follower is driven to follow the movement of the switch operation shaft. An attraction member generates magnetic force attracting the follower so that the follower becomes immovable and holding the switch operation shaft at a single operation position.

A further aspect of the present invention is a switch device for setting a control amount for an apparatus. The switch device includes a casing, a switch operation shaft rotatably supported by the casing and rotated between a plurality of operation positions for setting the control amount for the apparatus, and a follower driven to follow the rotation of the switch operation shaft. An attraction member generates magnetic force attracting the follower so that the follower becomes immovable and holding the switch operation shaft at a single operation position. An elastic member, arranged between the attraction member and the casing, elastically fixes the attraction member to the casing. A click control mechanism attracts and non-attracts the switch operation shaft with the attraction member at a plurality of predetermined operation positions to generate a click with the switch operation shaft for each of the operation positions.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A switch device according to a first embodiment of the present invention will now be described.

Figure 1:
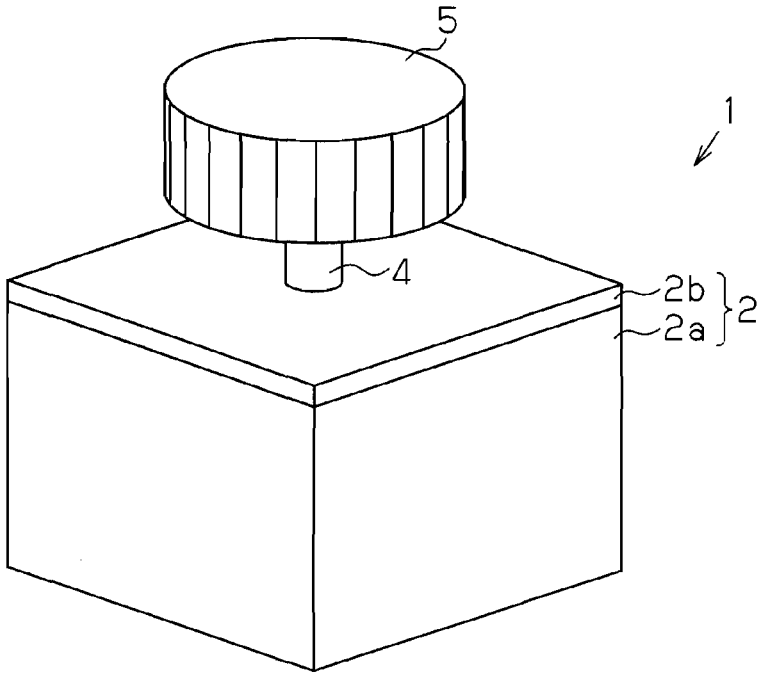
FIG. 1 is a perspective view showing a switch device according to a first embodiment of the present invention.
Figure 2:
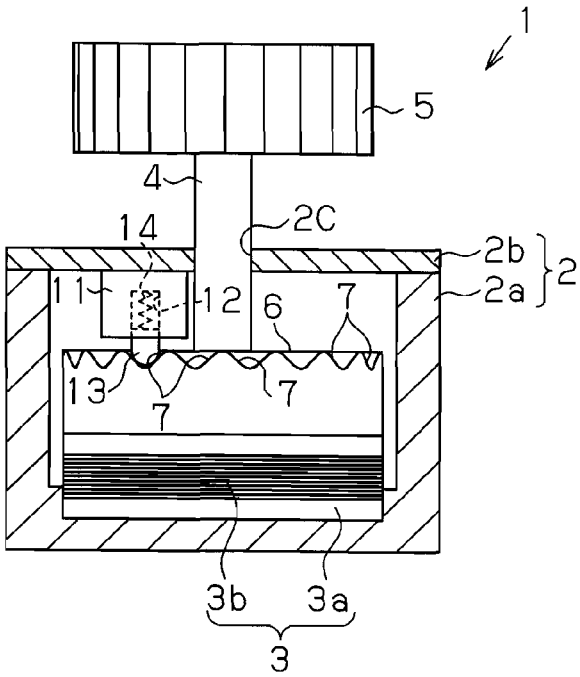
FIG. 2 is a cross-sectional view of the switch device of FIG. 1.

FIGS. 1 and 2 show a switch device 1 used to operate a vehicle device arranged in a center cluster panel inside the passenger compartment of a vehicle. The switch device 1 includes a switch casing 2. The switch casing 2 includes a box 2*a* and a lid 2*b*. An electromagnet 3 functioning as an attraction member is fixed to the bottom of the switch casing 2 in a manner that it cannot be moved relative to the switch casing 2. The electromagnet 3 includes a cylindrical-shaped core 3*a* and a coil 3*b* wound around the core 3*a*. The electromagnet 3 generates magnetic force when current is supplied to the coil 3*b*.

A switch operation shaft (hereafter simply referred to as the operation shaft) 4 functioning as a rotary shaft is rotatably supported in the switch casing 2. The operation shaft 4 extends through a hole 2C formed in the lid 2*b*. The operation shaft 4 is rotatable about its axis. The operation shaft 4 is not axially movable. The operation shaft 4 has a distal end projecting out of the switch casing 2 and a basal end accommodated in the switch casing 2. A knob 5 is fixed to the distal end of the operation shaft 4. A follower plate 6 functioning as a follower is arranged on the basal end of the operation shaft 4. The follower plate 6 is preferably made of a magnetic material. In the first embodiment, the follower plate 6 is made of steel. However, the follower plate 6 may be made of other magnetic materials. The follower plate 6 is fixed to the operation shaft 4 so as to rotate integrally with the operation shaft 4. The follower plate 6 has a lower surface which is in contact with a magnetic pole surface of the core 3*a*.

When an operator operates the knob 5 in a state in which the electromagnet 3 is inactive and not supplied with current, the follower plate 6 rotates integrally with the operation shaft 4. This causes the lower surface of the follower plate 6 to move along the magnetic pole surface of the core 3*a* with friction and pressure.

When the coil 3*b* of the electromagnet 3 is supplied with current, the electromagnet 3 is activated to generate magnetic force. The magnetic force attracts the lower surface of the follower plate 6 to the magnetic pole surface of the core 3*a* such that the follower plate 6 becomes immovable. This holds the operation shaft 4 at the present position in an immovable manner. The magnetic attraction force generated by the electromagnet 3 to attract the operation shaft 4 is determined in advance. In one example, the magnetic attraction force is determined so that the operation shaft 4 does not rotate when the operator turns the knob 5 with a relatively weak force but rotates when the operator turns the knob 5 with a relatively strong force. In other words, the magnetic attraction force is determined in a manner that the operator can recognize the resistance produced by the magnetic attraction force of the electromagnet 3. When recognizing the magnetic attraction force of the electromagnet 3, the operator acknowledges that the operation shaft 4 has reached one of two limit positions defining the operable rotational angle range and that further rotation is restricted. Further, the operator may rotate the operation shaft 4 from one limit position towards the other limit position against the magnetic attraction force of the electromagnet 3. The magnetic attraction force may be determined by conducting experiments to measure the relationship between the value of the current flowing to the coil 3*b* of the electromagnet 3 and the magnetic attraction force.

The follower plate 6 has an upper surface including a plurality of grooves 7. The grooves 7 radially extend from the center of the follower plate 6 and are formed at equal intervals.

The lid 2*b* has a lower surface to which a base 11 having an accommodation hole 12 is fixed. A coil spring 14 elastically connects the base 11 to a positioning pin 13, which has a generally semispherical distal end. The coil spring 14 urges the positioning pin 13 towards the upper surface of the follower plate 6.

When the operation shaft 4 is turned in a state in which the positioning pin 13 is fitted into an opposing groove 7, the positioning pin 13 is moved into the accommodation hole 12 against the urging force of the coil spring 14. Then, the positioning pin 13 is moved over a ridge defined between two adjacent grooves 7 and fitted into the adjacent groove 7. The operation force necessary to move over the ridge is transmitted via the follower plate 6, the operation shaft 4, and the knob 5 to the operator as operation resistance. Therefore, the operator receives the operation resistance whenever the positioning pin 13 moves over a ridge while turning the operation shaft 4. Thus, the operator recognizes clicks when turning the operation shaft 4 even if the follower plate 6 is not attracted to the electromagnet 3. The coil spring 14, the positioning pin 13, and the grooves 7 form a click mechanism or a positioning mechanism for producing operation resistance.

A switch detection circuit 26 (see FIG. 3) for detecting the rotation of the operation shaft 4 and generating a detection signal corresponding to the rotation amount of the operation shaft 4 is arranged in the switch casing 2.

Figure 3:
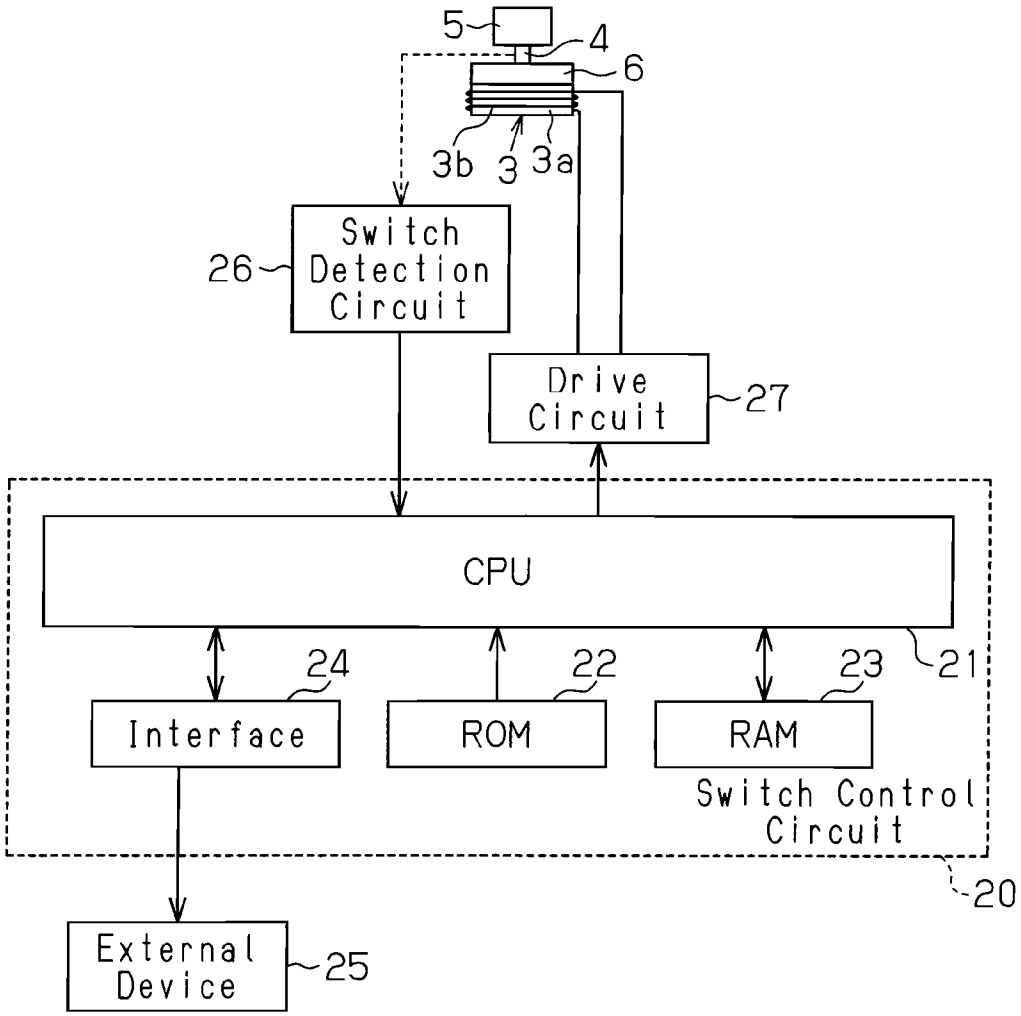
FIG. 3 is a block diagram showing the electric circuit of the switch device of FIG. 1.

A switch control circuit 20 for controlling the activation of the switch device 1 will now be discussed with reference to FIG. 3. The switch control circuit 20 includes a CPU 21, a ROM 22, a RAM 23, and an interface 24. The CPU 21 controls the drive of the electromagnet 3 in accordance with various programs stored in the ROM 22 using the RAM 23 as a working space. Further, the CPU 21 generates a control signal corresponding to the operation amount of the operation shaft 4 and provides the signal to an external device 25. The two limit positions defining the operable rotational angle range of the operation shaft 4 are stored in the ROM 22. The two limit positions are, for example, a home position and a maximum operation position, respectively.

The CPU 21 receives the detection signal, which corresponds to the rotation amount of the operation shaft 4, from the switch detection circuit 26. The CPU 21 calculates the rotation amount, that is, the operation position of the operation shaft 4, from the detection signal in accordance with a program. If the calculated operation position is either one of the limit positions (home position or maximum operation position) stored in the ROM 22, the CPU 21 provides an ON signal to the drive circuit 27. The drive circuit 27 supplies the coil 3*b* of the electromagnet 3 with current in response to the ON signal. If the calculated operation position is located between the limit positions, the CPU 21 provides an OFF signal to the drive circuit 27. The drive circuit 27 stops supplying current to the coil 3*b* of the electromagnet 3 in response to the OFF signal.

The CPU 21 generates a control signal corresponding to the calculated operation position. The control signal is provided to the external device 25 via the interface 24. The external device 25 controls the activation of an apparatus (not shown) in accordance with the control signal.

The operation of the switch device 1 will now be discussed.

A state in which the operation shaft 4 is located at the home position, while the electromagnet 3 is attracted to the follower plate 6 will be discussed by way of example. When the operator rotates the knob 5 towards the other limit position (maximum operation position) against the attraction force of the electromagnet 3, the switch detection circuit 26 provides the CPU 21 with a detection signal corresponding to the operation amount of the operation shaft 4.

The CPU 21 calculates the rotation amount (operation position) of the operation shaft 4 from the detection signal. The CPU 21 then generates the control signal corresponding to the calculated operation position and provides the control signal to the external device 25 via the interface 24. The CPU 21 determines whether or not the calculated operation position corresponds to one of the two limit positions (home position or maximum operation position) stored in the ROM 22. If the calculated operation position does not correspond to any one of the limit positions, the CPU 21 provides the drive circuit 27 with an OFF signal to stop supplying current to the coil 3*b* of the electromagnet 3. The follower plate 6 is then released from the attraction force of the electromagnet 3. This enables the operator to operate the knob 5 freely from the attraction force of the electromagnet 3 while recognizing sharp clicks (or operation resistance) with the click mechanism.

When the knob 5 reaches the maximum operation position, the CPU 21 provides the drive circuit 27 with an ON signal to supply current to the coil 3*b* of the electromagnet 3. The activated electromagnet 3 attracts the follower plate 6. Thus, the operator recognizes the resistance force through the knob 5. As a result, the operator becomes aware that the knob 5 has reached the maximum operation position and stops rotating the knob 5.

Rotation from the maximum operation position towards the home position is performed in the same manner.

The first embodiment has the advantages described below.

(1) The switch device 1 of the first embodiment includes the follower plate 6, which is fixed to the operation shaft 4 and made of magnetic material member, and the electromagnet 3, which faces toward the follower plate 6 and which is fixed in the switch casing 2. When the electromagnet 3 generates magnetic force, the follower plate 6 is attracted to and fixed to the electromagnet 3. Thus, the follower plate 6 may be attracted to and fixed to the electromagnet 3 at any position by simply controlling the timing for supplying current to the electromagnet 3. The operation shaft 4 may be held by the magnetic force at any operation position. As a result, the operable rotational angle range of the operation shaft 4 is variable. This increases the versatility of the switch device 1 enhances.

(2) The switch device 1 of the first embodiment uses the magnetic force of the electromagnet 3 to hold the operation shaft 4 at any operation position. The structure for magnetically holding the operation shaft 4 includes the electromagnet 3 arranged at the bottom of the switch casing 2 and the follower plate 6 located next to the electromagnet 3. This is a very simple structure and contributes to further miniaturization of the switch device 1.

(3) The switch device 1 of the first embodiment includes the ROM 22 for storing the holding positions of the operation shaft 4. The operable rotational angle range of the operation range of the operation shaft 4 is set just by storing the holding positions in the ROM 22. When necessary, the operable rotational angle range of the operation shaft 4 may be varied by replacing the ROM 22.

(4) The switch device 1 of the first embodiment incorporates the click mechanism including the positioning pin 13, which is urged towards the grooves 7 of the follower plate 6. This enables the operator to recognize a click whenever the positioning pin 13 rides over a ridge between two adjacent grooves 7 when turning the knob 5.

A switch device according to a second embodiment of the present invention will now be discussed focusing on differences from the first embodiment.

Figure 4:
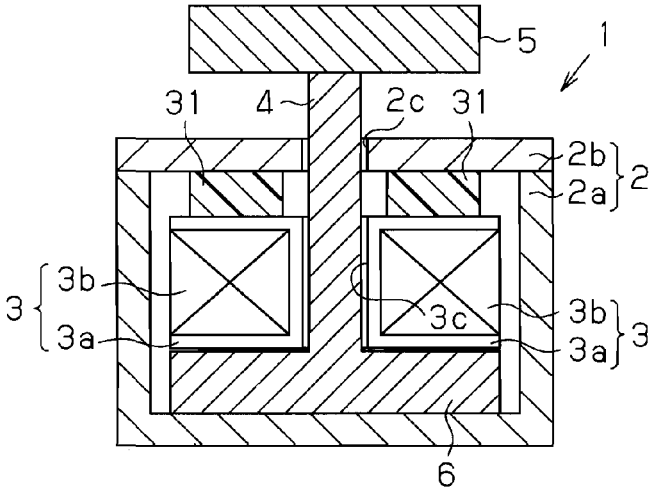
FIG. 4 is a cross-sectional view of a switch device according to a second embodiment of the present invention.

As shown in FIG. 4, the electromagnet 3 is arranged between the follower plate 6 and the lid 2*b* of the switch casing 2 in the switch device 1 of the second embodiment. Specifically, the operation shaft 4 extends through a hole 3*c* formed in the core 3*a* of the electromagnet 3. Furthermore, the electromagnet 3 is fixed to the lid 2*b* by an elastic member 31. The elastic member 31 is annular and made of rubber. When the electromagnet 3 receives force that rotates the operation shaft 4, the elastic member 31 elastically deforms and permits slight rotation of the electromagnet 3 in the direction of the force rotating the operation shaft 4.

When the knob 5 is turned to rotate the operation shaft 4 in a state in which the electromagnet 3 is inactive, the follower plate 6 is not attracted to the electromagnet 3. Thus, the follower plate 6 rotates in cooperation with the operation shaft 4.

When the operation shaft 4 is rotated in a state in which the electromagnet 3 is active, the follower plate 6 is attracted to the electromagnet 3 and slight rotation of the electromagnet 3 is permitted by the elastic deformation of the elastic member 31. Thus, the follower plate 6 and the electromagnet 3 rotate integrally. Elastic reaction force increases as elastic deformation amount of the elastic member 31 increases. This gradually increases the operation force required to rotate the knob 5 when the electromagnet 3 is active.

Figure 5A:
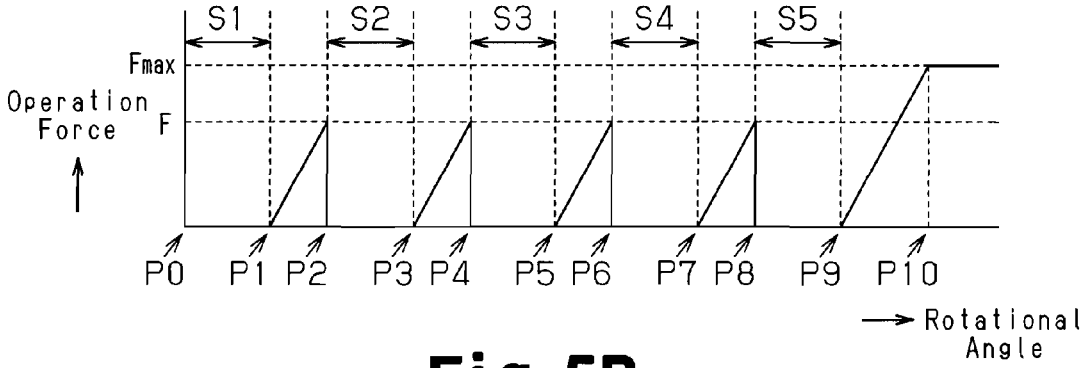
FIG. 5A is a graph showing the relationship between the rotational angle and the operation force of a switch operation shaft in the switch device of the second embodiment.

The CPU 21 uses the change in the required operation force in order to produce clicks when the knob 5 is rotated. A control executed by the CPU 21 to produce clicks will now be discussed. FIG. 5A shows an operable rotational angle range of the knob 5 range defined between point P0 and point P9. Five operation positions, namely, first operation position S1 to fifth operation position S5, are set within the operable rotational angle range. The generation of clicks between operation positions S1 to S5 will now be discussed.

The CPU 21 inactivates the electromagnet 3 when the operation shaft 4 is located at the first operation position S1, second operation position S2, third operation position S3, fourth operation position S4, and fifth operation position S5. Thus, when the knob 5 is rotated, only the operation shaft 4 and the follower plate 6 rotate at each of operation positions S1 to S5. In such cases, the operation force required to rotate the knob 5 is very small.

The CPU 21 activates the electromagnet 3 when the operation shaft 4 is located between the operation positions S1 and S5, that is, between point P1 and point P2, between point P3 and point P4, between point P5 and point P6, and between point P7 and point P8. In such cases, the follower plate 6 is attracted to the electromagnet 3. Thus, the follower plate 6 rotates with the electromagnet 3. Rotation of the electromagnet 3 is permitted by the elastic deformation of the elastic member 31. Thus, the operation force required to rotate the knob 5 at each of points P1, P3, P5, and P7 is relatively small. However, as the operation shaft 4 approaches each of points P2, P4, P6, and P8, the elastic reaction force of the elastic member 31 increases and gradually increases the operation force required to rotate the knob 5. When the operation shaft 4 reaches each of points P2, P4, P6, and P8, the CPU 21 inactivates the electromagnet 3 to release the follower plate 6 from the attraction of the electromagnet 3. As a result, the elastic member 31 returns to the shape which it originally had prior to the elastic deformation, the electromagnet 3 returns to the position where it was located prior to the rotation, and the operation force required to rotate the knob 5 decreases suddenly. In this manner, the CPU 21 controls the attraction of the follower plate 6 with the electromagnet 3 to produce clicks when the knob 5 is rotated. The operation positions S1 to S5 correspond to the grooves 7 of the first embodiment, and the positions outside the operation positions S1 to S5 correspond to the ridges defined between two adjacent grooves 7 of the first embodiment. The CPU 21 functions as a click control circuit for controlling the operable rotational angle range of the operation shaft 4.

The CPU 21 switches the electromagnet 3 to an inactive state when the operation force required to rotate the knob 5 reaches a predetermined operation force F, which is smaller than the maximum operation force Fmax. In other words, points P2, P4, P6, and P8 are set at locations where the operation force required to rotate the knob 5 reaches the predetermined operation force F. The CPU 21 switches the electromagnet 3 to an inactive state at points P2, P4, P6, and P8 so that the knob 5 can be rotated with the predetermined operation force F. The maximum operation force Fmax is the force at which the elastic member 31 reaches the limit of elastic deformation and the follower plate 6 starts to slide on the electromagnet 3.

When the knob 5 is rotated to the limit position (point P9) of the operable rotational angle range, the CPU 21 switches the electromagnet 3 to an active state. The CPU 21 maintains the electromagnet 3 in the active state even if the knob 5 is continuously rotated and the operation force required to rotate the knob 5 reaches the maximum operation force Fmax (point P10). This enables the operator to become aware that the knob 5 has reached the limit position of the operable rotational angle range before rotating the knob 5 to the position indicated by point P10.

The following disadvantages would arise if the elastic member 31 were to be omitted and the electromagnet 3 were to be directly fixed to the lid 2*b* of the switch casing 2.

Figure 5B:
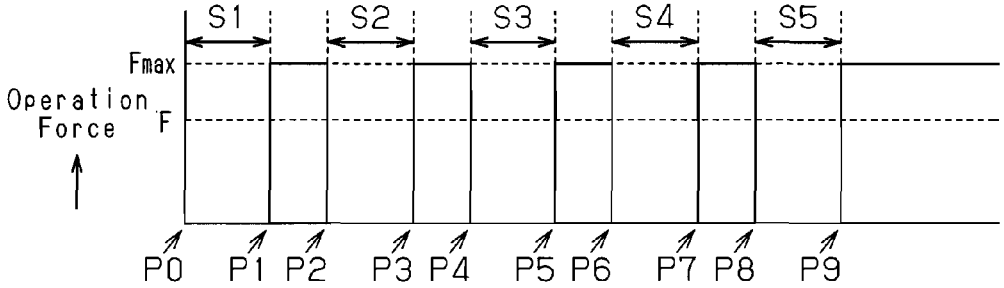
FIG. 5B is a graph showing the relationship between the rotational angle and the operation force of a switch operation shaft in the switch device of a comparative example.

As shown in FIG. 5B, when the electromagnet 3 is activated at each resistance position (between P1-P2, between P3-P4, between P5-P6, and between P7-P8) excluding operation positions S1 to S5, the operation force of the knob 5 required for rotation between switch operation positions S1 to S5 becomes the maximum operation force Fmax. The operation force required to rotate the knob 5 is also the maximum operation force Fmax when the knob 5 is located at the limit position (point P9) of the operable rotational angle range. Thus, a large operation force is constantly required for rotation between the operation positions S1 to S5. This lowers the operability lowers and makes it difficult for an operator to become aware that the operation shaft 4 has reached the limit position of the operable rotational angle range.

The second embodiment has the advantages described below.

(5) When the follower plate 6 reaches an attraction initiation position (point P1, P3, P5, and P7), the electromagnet 3 starts to attract the follower plate 6. If the knob 5 is further rotated from the attraction initiation position, the electromagnet 3 is rotated following the knob 5. This elastically deforms the elastic member 31 and gradually increases the reaction force applied to the knob 5. The attraction of the follower plate 6 to the electromagnet 3 is released when the knob 5 reaches an attraction release position (point P2, P4, P6, and P8). As a result, only the operation shaft 4 and the follower plate 6 move, the reaction force from the elastic member 31 is no longer applied to the knob 5, the elastic member 31 is no longer elastically deformed, and the electromagnet 3 returns to the position it was originally located prior to following the rotation of the knob 5. Thus, the activation and inactivation control of the electromagnet 3 produces clicks when rotating the knob 5 (operation shaft 4). The attraction initiation position and the attraction release position may easily be varied through the activation and inactivation control of the electromagnet 3. This further improves the versatility of the switch device 1.

(6) Instead of using a non-attraction type click mechanism (i.e., grooves 7, positioning pin 13, etc.) of the first embodiment, the second embodiment uses an attraction type click mechanism that includes the elastic member 31 and controls the activation and inactivation of the electromagnet 3. Thus simplifies the structure of the switch device 1 and ensures that clicks are produced.

(7) The rubber elastic member 31 is arranged between the electromagnet 3 and the switch casing 2. Thus, clicks are produced with a simple structure when rotating the knob 5 (operation shaft 4).

(8) The elastic member 31 is arranged between the electromagnet 3 and the switch casing 2. Thus, if the knob 5 is rotated when the follower plate 6 is attracted to the electromagnet 3, the electromagnet 3 is rotated by a tolerable elastic deformation amount of the elastic member 31. When the knob 5 is released from the operation force, the knob 5 returns to its original position together with the electromagnet 3. By using such action, the switch device 1 may be employed as a momentary switch device.

It should be apparent to those skilled in the art that the present invention may be embodied in many other specific forms without departing from the spirit or scope of the invention. Particularly, it should be understood that the present invention may be embodied in the following forms.

The operable rotational angle of the knob 5 (operation shaft 4) is not particularly limited in the switch device 1 of each embodiment and may be changed as required to 45 degrees, 90 degrees, 120 degrees, 180 degrees, 270 degrees, 360 degrees, or 360 degrees or greater (e.g., 450 degrees).

In the switch device 1 of each embodiment, the holding positions are not limited to two positions and may be three positions. For instance, a second holding position in the clockwise direction and a third holding position in the counterclockwise direction with respect to the home position (first holding position) may be set. In this case, the operable rotational angle range in the clockwise direction and the operable rotational angle range in the counterclockwise direction may be set based on the home position to be the same or to differ from each other.

The switch device 1 of the first embodiment incorporates the click mechanism including the grooves 7 formed in the upper surface of the follower plate 6, the positioning pin 13 elastically pushed into the grooves 7 by the coil spring 14, and the like. However, the present invention may be applied to a switch device that does not incorporate a click mechanism.

The switch device 1 discusses in each embodiment is a rotary switch device in which the operation shaft 4 is rotated by the knob 5. However, the switch device 1 may be applied to a slide switch device in which a switch operation shaft slides to switch operation positions.

In the switch device 1 of each embodiment, the entire follower plate 6 is formed by a magnetic material member. Instead, a plate made of a magnetic material (e.g., steel plate) may be attached to the lower surface of a plate made of a synthetic resin or the like.

The switch device 1 of the first embodiment includes the electromagnet 3, which is arranged on the lower surface of the follower plate 6. However, the electromagnet 3 may be arranged on the upper surface of the follower plate 6 in the same manner as in the second embodiment. Furthermore, in the switch device 1 of the second embodiment, the electromagnet 3 may be arranged on the lower surface of the follower plate 6 or between the follower plate 6 and the bottom of the box 2*a* of the switch casing 2 like in the first embodiment.

The elastic member 31 does not necessarily need to be made of rubber in the second embodiment and may be made of, for example, a spring material. However, rubber is preferable for simplifying the structure.

In the second embodiment, the CPU 21 controls the activation and inactivation of the electromagnet 3 within the operable rotational angle range of the knob 5 to produce clicks when the knob 5 is rotated. However, the CPU 21 does not necessarily have to control the generation of such clicks and may control only the two limit positions of the operational rotational angle range of the knob 5.

In the second embodiment, the CPU 21 may perform only the control for generating clicks during rotation of the knob 5 and does not need to perform the control of the two limit positions of the operational rotational angle range of the knob 5.

The elastic member 31 is formed by a single rubber member having a generally annular shape. However, the elastic member 31 is not limited to such shape and may be formed by a plurality of plates. In other words, the elastic member 31 may have any shape. Furthermore, the elastic member 31 may be arranged between the outer surface of the electromagnet 3 and the inner surface of the box 2*a* of the switch casing 2. Further, in addition to vehicle devices, such as a car navigation system, an air conditioner system, an audio system, the switch device 1 may be used for other devices such as electronic consumer products.

The lower surface of the follower plate 6 may be slightly spaced apart from the magnetic pole surface of the core 3*a* when the electromagnet 3 is in an inactivated state.

The present examples and embodiments are to be considered as illustrative and not restrictive, and the invention is not to be limited to the details given herein, but may be modified within the scope and equivalence of the appended claims.

What is claimed is:

1. A switch device for setting a control amount for an apparatus, the switch device comprising:

a switch operation shaft movable between a plurality of operation positions for setting the control amount for the apparatus;

a follower driven to follow the movement of the switch operation shaft; and an attraction member for generating magnetic force attracting the follower so that the follower becomes immovable and holding the switch operation shaft at a single operation position.

2. The switch device according to claim 1, further comprising:

a casing for rotatably supporting the switch operation shaft, wherein:

the switch operation shaft is rotated to switch between the operation positions;

the follower is attached to the switch operation shaft so as to be integrally rotatable with the switch operation shaft; and the attraction member is fixed to the casing and disables rotation of the switch operation shaft by attracting the follower with the magnetic force so that the follower becomes immovable.

3. The switch device according to claim 2, further comprising:

a click mechanism for generating a click when an operator moves the switch operation shaft from one operation position to another operation position, the click mechanism being partially arranged in the casing.

4. The switch device according to claim 3, wherein the click mechanism is a non-attraction type click mechanism including:

a plurality of grooves formed in one of the casing and the follower and extending transverse to the direction in which the follower is moved; and a positioning pin arranged on the other one of the casing and the follower to be urged toward and fitted into an opposing one of the grooves.

5. The switch device according to claim 3, wherein:

the attraction member is elastically fixed to the casing by an elastic member; and the click mechanism includes an attraction type click mechanism for attracting and non-attracting the switch operation shaft with the attraction member at a plurality of predetermined operation positions to generate a click with the switch operation shaft for each of the operation positions.

6. The switch device according to claim 5, wherein the elastic member is a rubber member arranged between the attraction member and the casing.

7. The switch device according to claim 1, wherein the follower is a magnetic material member arranged on the switch operation shaft to move in cooperation with the movement of the switch operation shaft; and the attraction member is an electromagnet for generating the magnetic force that attracts the magnetic material member when activated.

8. The switch device according to claim 1, further comprising:

a control circuit for detecting a present operation position of the switch operation shaft and activating the electromagnet when the detected operation position corresponds to at least one of predetermined operation positions.

9. The switch device according to claim 1, wherein the control circuit:

stores at least one limit position defining an operable rotational angle range for the switch operation shaft; and activates the electromagnet when the switch operation shaft reaches the at least one limit position to disable further movement of the switch operation shaft with the magnetic force generated by the electromagnet.

10. The switch device according to claim 9, wherein the at least one limit position stored in the control circuit is variable.

11. A switch device for setting a control amount for an apparatus, the switch device comprising:

a casing;

a switch operation shaft rotatably supported by the casing and rotated between a plurality of operation positions for setting the control amount for the apparatus;

a follower driven to follow the rotation of the switch operation shaft;

an attraction member for generating magnetic force attracting the follower so that the follower becomes immovable and holding the switch operation shaft at a single operation position;

an elastic member, arranged between the attraction member and the casing, for elastically fixing the attraction member to the casing; and a click control mechanism for attracting and non-attracting the switch operation shaft with the attraction member at a plurality of predetermined operation positions to generate a click with the switch operation shaft for each of the operation positions.

12. A rotary switch device having a variable operable rotational angle range for setting a control amount for an apparatus, the rotary switch device comprising:

a switch operation shaft rotatable between a plurality of operation positions for setting the control amount for the apparatus, the switch operation shaft being rotated within the operable rotational angle range;

a follower driven to follow the rotation of the switch operation shaft; and an attraction member for generating magnetic force attracting the follower so that the follower becomes immovable when the switch operation shaft reaches a limit position that defines the operable rotational angle range and holding the switch operation shaft at the limit position in order to disable further rotation of the switch operation shaft.

* * * * *